US008122631B2

(12) United States Patent
Lee-Hinds

(10) Patent No.: US 8,122,631 B2
(45) Date of Patent: Feb. 28, 2012

(54) FUNERAL FLOWER

(76) Inventor: Kao Youa Pa Lee-Hinds, Clovis, CA (US)

( * ) Notice: Subject to any disclaimer, the term of this patent is extended or adjusted under 35 U.S.C. 154(b) by 210 days.

(21) Appl. No.: 12/716,655

(22) Filed: Mar. 3, 2010

(65) Prior Publication Data

US 2010/0159159 A1 Jun. 24, 2010

Related U.S. Application Data

(60) Provisional application No. 61/254,444, filed on Oct. 23, 2009.

(51) Int. Cl.
*A41G 1/00* (2006.01)

(52) U.S. Cl. ..... 40/725; 40/539; 428/24; 428/26

(58) Field of Classification Search ..... 428/24, 428/26; 47/39, 41.01, 41.1, 41.12, 41.14; 40/645, 538, 539, 725
See application file for complete search history.

(56) References Cited

U.S. PATENT DOCUMENTS

| | | | | | |
|---|---|---|---|---|---|
| 2,581,452 | A | * | 1/1952 | Solomon | 518/724 |
| 2,702,441 | A | * | 2/1955 | Jones | 312/204 |
| 2,761,233 | A | * | 9/1956 | Brown | 47/41.1 |
| 4,445,298 | A | * | 5/1984 | Roder | 47/41.12 |
| 4,888,221 | A | * | 12/1989 | Tischer | 428/18 |
| 5,236,748 | A | * | 8/1993 | Cheng | 428/26 |

* cited by examiner

*Primary Examiner* — Casandra Davis
(74) *Attorney, Agent, or Firm* — Merchant & Gould P.C.

(57) ABSTRACT

An ornamental funeral flower includes a base, a riser fixedly attached to the center of the base, and support members extending from the riser to the edge of the base. The flower also includes an attachment layer attached to one or more of the base, riser, and support members, and petals fixedly attached to the attachment layer.

17 Claims, 12 Drawing Sheets

FUNERAL FLOWER

BACKGROUND

One of the traditional rites performed during Hmong funerals is a ceremonial burning of symbolic Joss paper intended to accompany the deceased into the afterlife. Historically, this Joss paper is spread throughout the location of the funeral ceremony.

SUMMARY

Example embodiments described herein relate to ornamental flowers that can be used during ceremonies, such as during traditional Hmong funeral ceremonies.

In one aspect, an ornamental funeral flower includes a base, a riser fixedly attached to the center of the base, and support members extending from the riser to the edge of the base. The flower also includes an attachment layer attached to one or more of the base, riser, and support members, and petals fixedly attached to the attachment layer.

In another aspect, a method of making an ornamental funeral flower includes: providing a base; attaching a riser to said base; extending a plurality of support members from the riser to the base; draping an attachment layer over said base, riser, and support members; and attaching a plurality of petals to said attachment layer.

DETAILED DESCRIPTION

Example embodiments described herein relate to ornamental flowers that can be used during ceremonies, such as during traditional Hmong funeral ceremonies.

Figure 1:
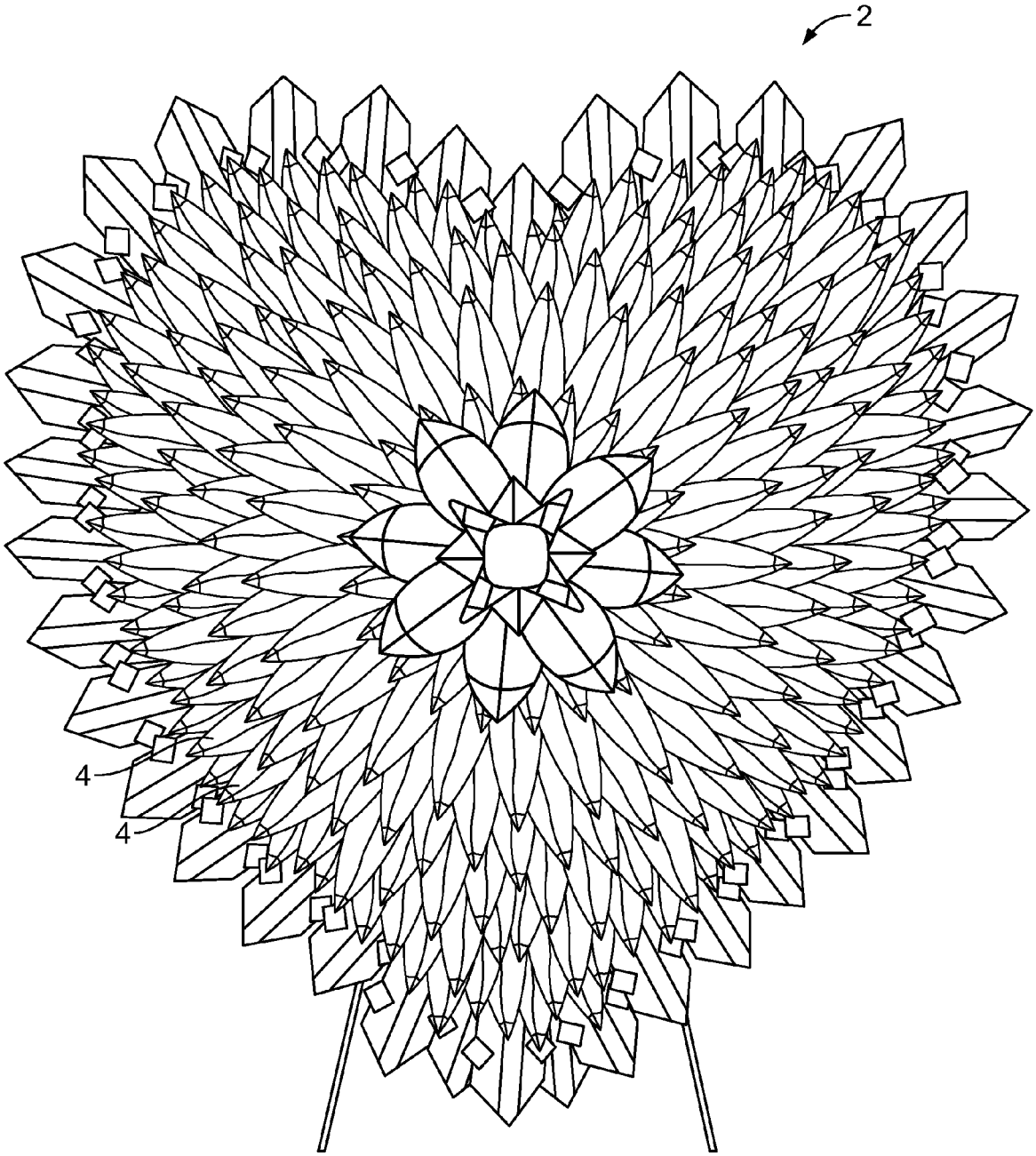
FIG. 1 is a front view of an ornamental funeral flower.

Referring to FIG. 1, an example ornamental funeral flower 2 is shown. In this embodiment, the funeral flower 2 is made up of a plurality of petals 4.

In one embodiment, each petal 4 is made of Joss paper, though other suitable materials may be used. If the material used to create each petal 4 is Joss paper, the ornamental flower provides a way to incorporate the symbolic Joss paper into an organized, aesthetically-pleasing decoration. When Joss paper is used, each petal 4 is made from a single sheet of Joss paper and is folded to mimic the appearance of a flower petal.

Figure 2:
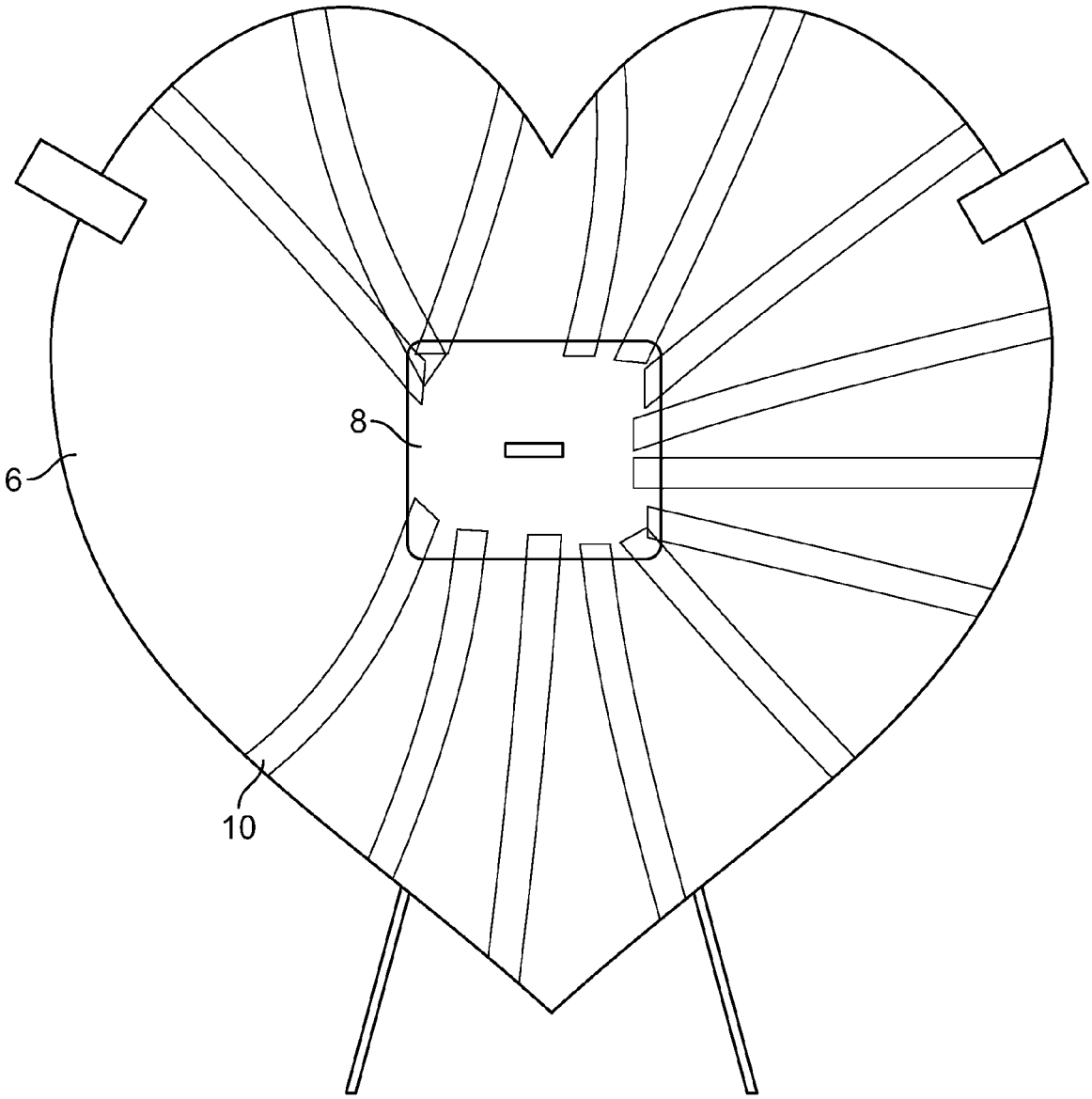
FIG. 2 is a front view of component parts of an ornamental funeral flower.

Referring to FIG. 2, the example ornamental funeral flower 2 is made using a base 6, a riser 8, and a plurality of support members 10.

In one embodiment, the riser 8 is placed at approximately the geometric center of the base 6 and fixedly attached to the base 6. The riser may be fixedly attached the base in a number of ways. For instance, either adhesives or mechanical fasteners may be used to accomplish this attachment. In one embodiment, this attachment is accomplished using a thermoplastic adhesive resin or "hot glue," though other adhesives may be used. In another embodiment, the riser 8 is stapled to the base, though other mechanical fasteners may be used.

Each support member 10 extends from the front face of the riser 8 to the outer edge of the base 6. Any number of support members may be used, but the number necessary will likely depend on a number of factors, such as the size of the ornamental funeral flower 2 and the density of petals 4 incorporated on the face of the flower. In one embodiment, the support members 10 are made of cellophane tape, but other materials, such as wire or string, may be used.

Figure 3:
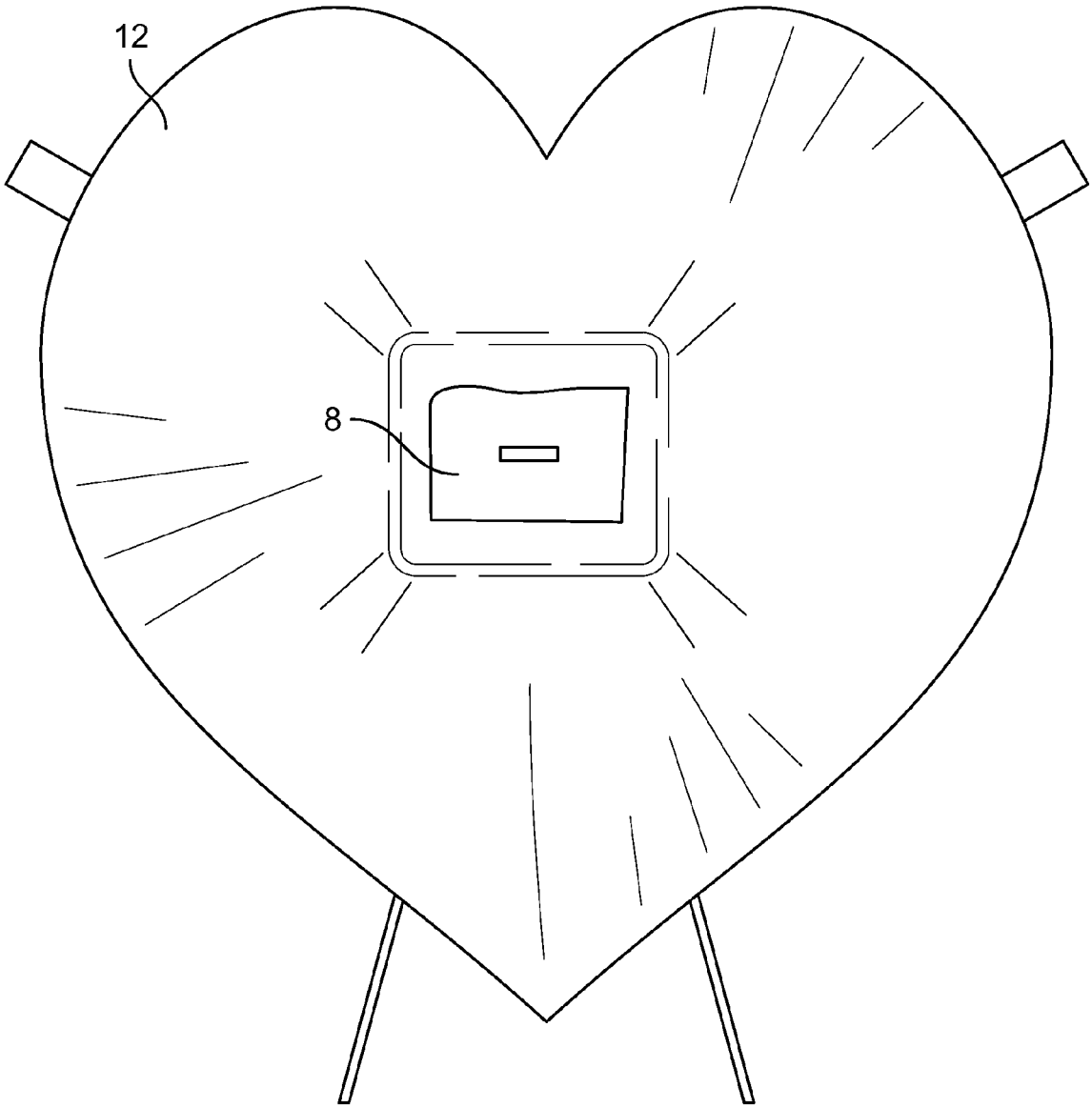
FIG. 3 is a front view of component parts of an ornamental funeral flower.

Referring to FIG. 3, an attachment layer 12 is draped over and fixedly attached to base 6, riser 8, and support members 10. The attachment layer 12 may be made of any of a variety of materials. In one embodiment, the attachment layer 12 is made of paper, such as masking paper or wrapping paper, but other suitable materials may be used.

Referring again to FIG. 1, a plurality of petals 4 are fixedly attached to the attachment layer 12 so that the flower 2 takes the appearance of a flower. The number of petals 4 attached to attachment layer 12 will vary depending on the desired size of the flower 2 and the desired density of petals 4.

The petals 4 may be attached to the attachment layer 12 in a variety of ways, such as adhesives or mechanical fasteners. For instance, thermoplastic adhesive resin or "hot glue" may be used, but other adhesives may also be appropriate. Alternatively, the petals 4 may be stapled to the attachment layer 12, but other mechanical fasteners may be appropriate.

Figure 4:
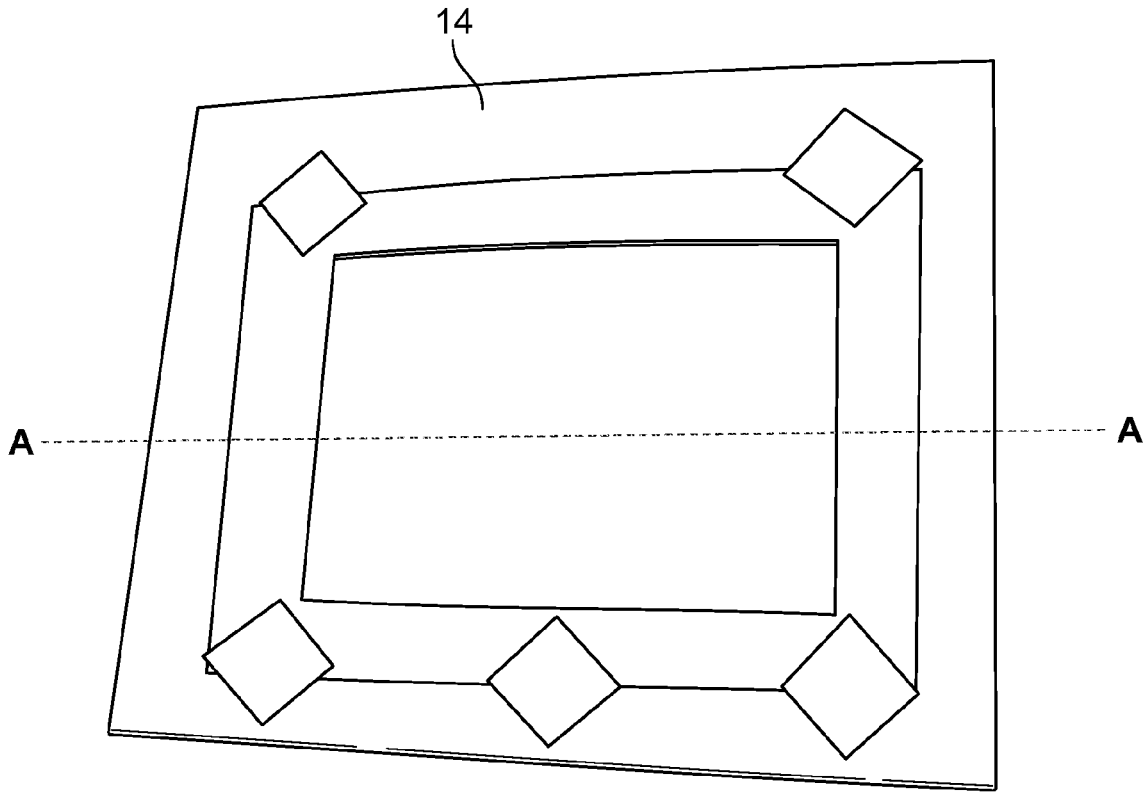
FIG. 4 is a perspective view of a sheet of Joss paper.

In one embodiment, each petal 4 attached to the attachment layer 12 is made of Joss paper. A sheet 14 of Joss paper is shown in FIG. 4. Each sheet 14 of Joss paper has a decorated side and an undecorated side. To form the sheet 14 of Joss paper into a petal 4, the sheet is folded along line A-A so that the undecorated side faces out.

Figure 5:
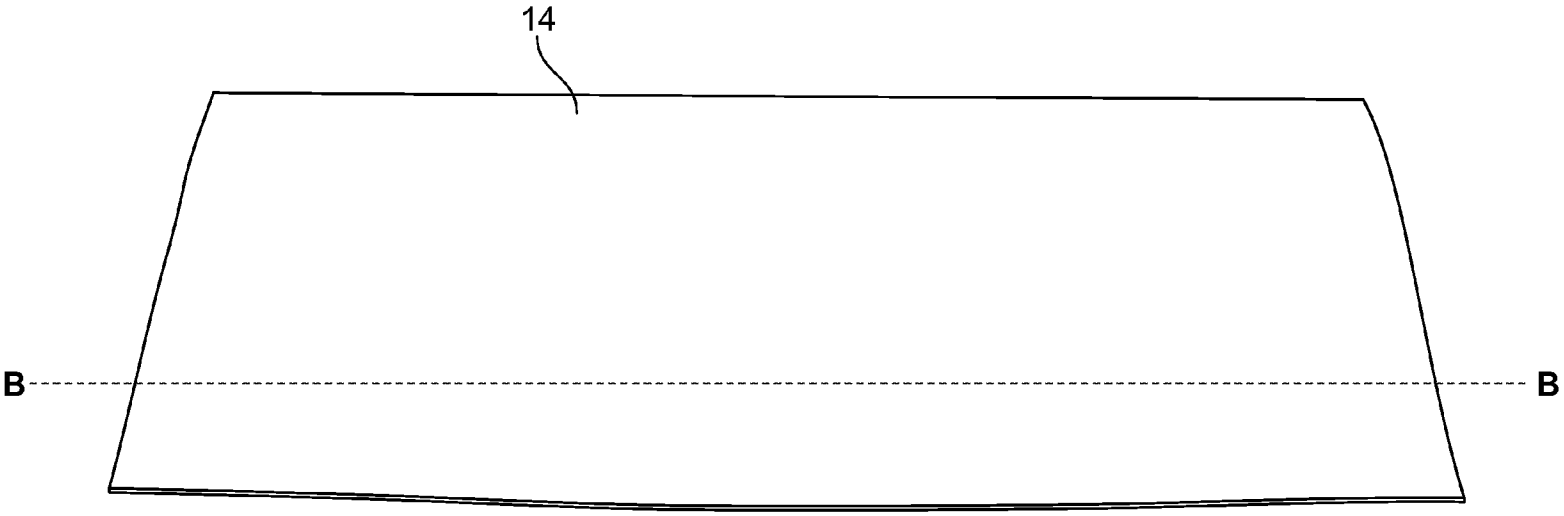
FIG. 5 is a perspective view of a folded sheet of Joss paper.

FIG. 5 depicts a sheet 14 of Joss paper after it is folded as described above. To continue forming the petal 4, the sheet is next folded along line B-B on each of its edges so that the edges of the sheet 14 flare out as depicted in FIG. 6.

Figure 6:
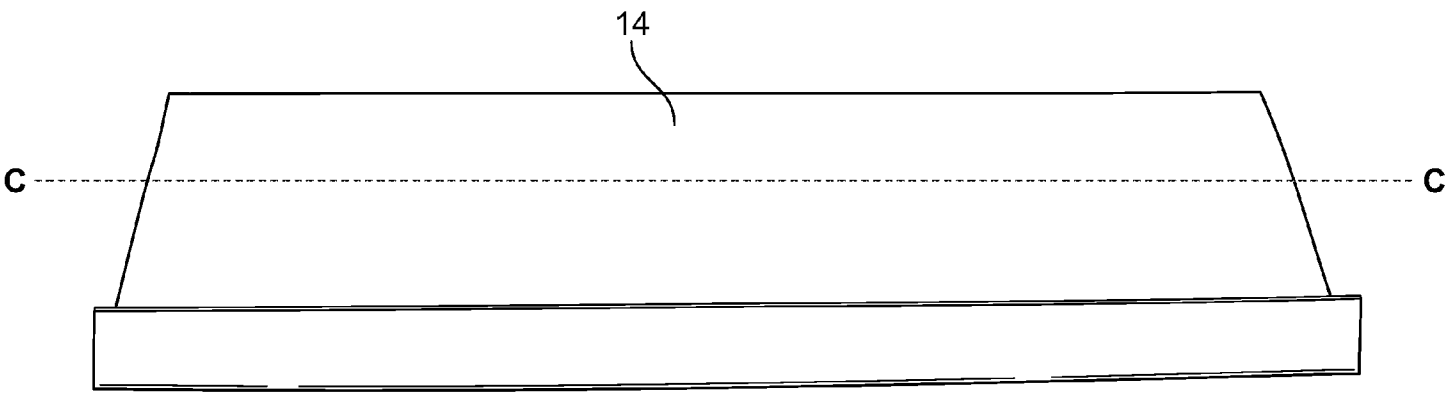
FIG. 6 is a perspective view of a further folded sheet of Joss paper.

FIG. 6 depicts a sheet 14 of Joss paper after it is folded as described above. To continue forming the petal 4, the sheet 14 is next folded along line C-C so the sheet 14 appears as depicted in FIG. 7.

Figure 7:
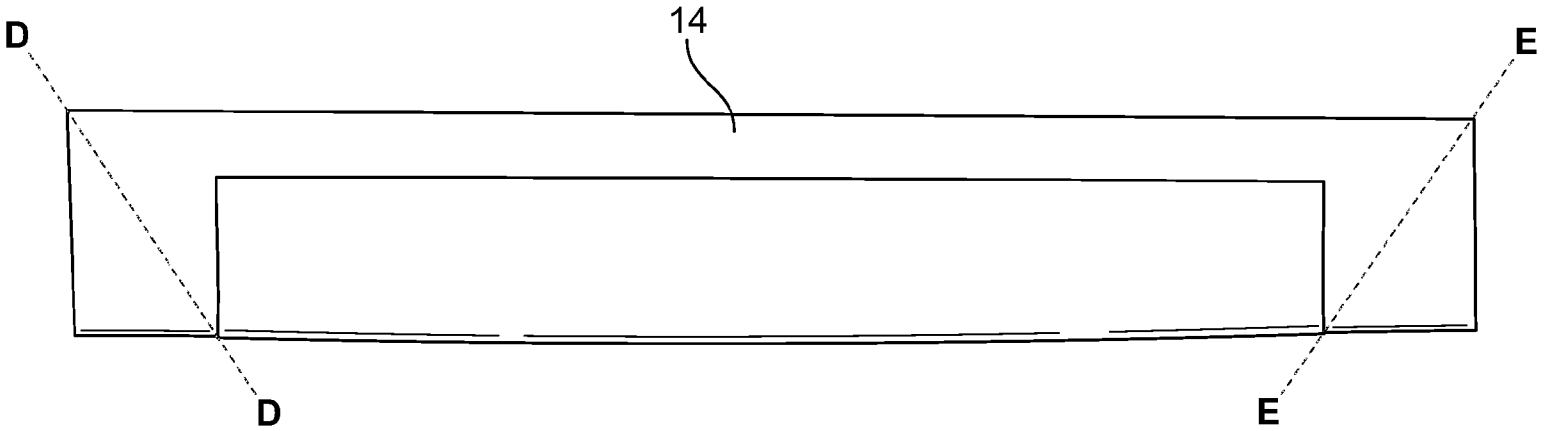
FIG. 7 is a perspective view of a further folded sheet of Joss paper.

FIG. 7 depicts a sheet 14 of Joss paper after it is folded as described above. To continue forming the petal 4, the sheet 14 is next folded along lines D-D and E-E so that the sheet 14 appears as depicted in FIG. 8.

Figure 8:
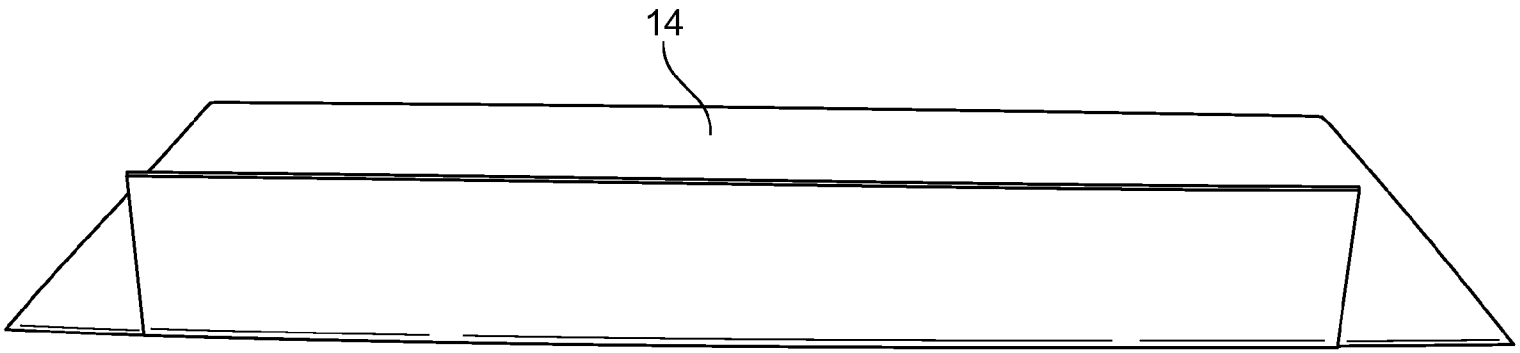
FIG. 8 is a perspective view of a further folded sheet of Joss paper.

FIG. 8 depicts a sheet 14 of Joss paper after it is folded as described above. To continue forming the petal 4, the sheet 14 is inverted and partially folded inside-out so that the sheet 14 appears as depicted in FIG. 9.

Figure 9:
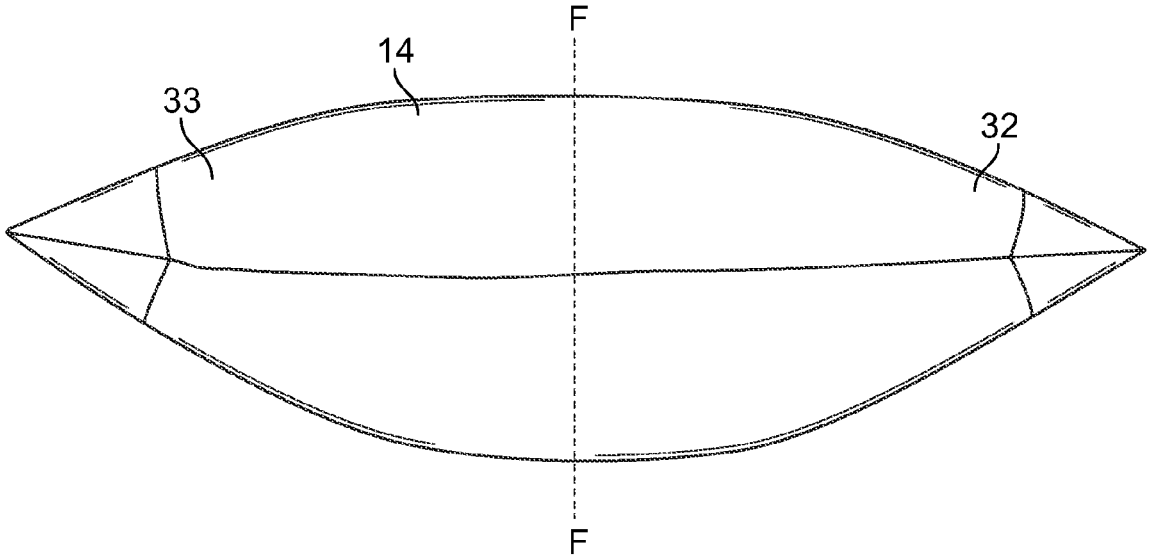
FIG. 9 is a front view of a sheet of Joss paper folded to form a petal.

FIG. 9 depicts a petal 4 folded and formed. After being folded in this manner, the petal 4 can be attached to the attachment layer 12 as described above. To complete the ornamental funeral flower 2, a plurality of petals 4 are formed as described above and attached to the attachment layer.

Figure 10:
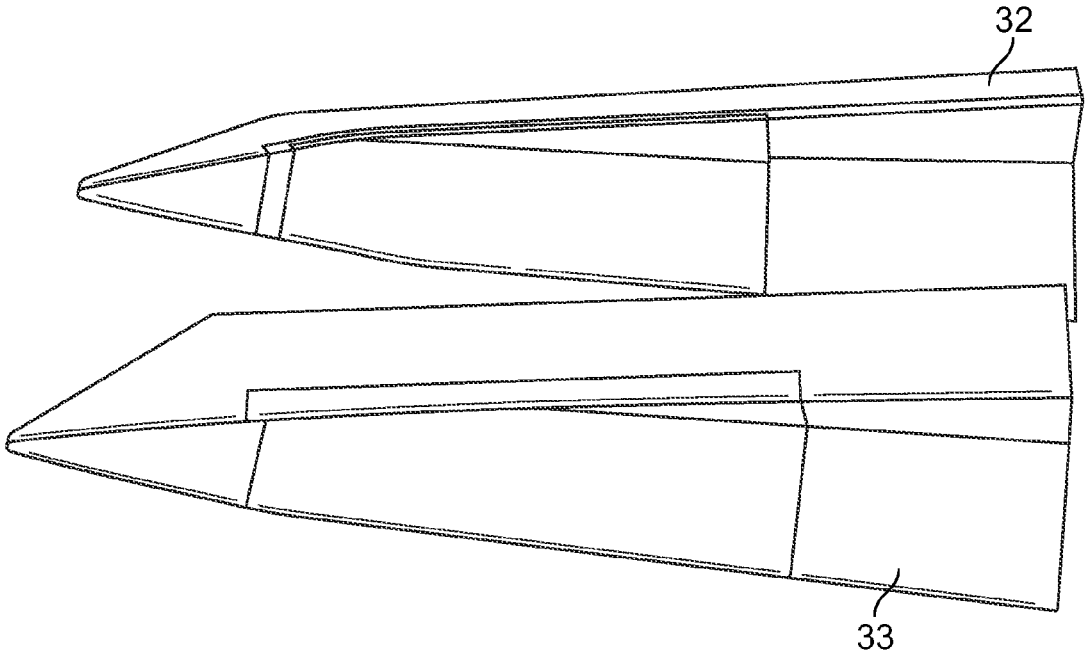
FIG. 10 is a front view of a petal cut to form two petals.

In some examples, the petal 4 can be cut so that the petal 4 can be used to form multiple petals. For example, the petal 4 can be cut along line F-F to form two petals 32, 33 that can be attached to the flower 2, as shown in FIGS. 9 and 10.

Figure 11:
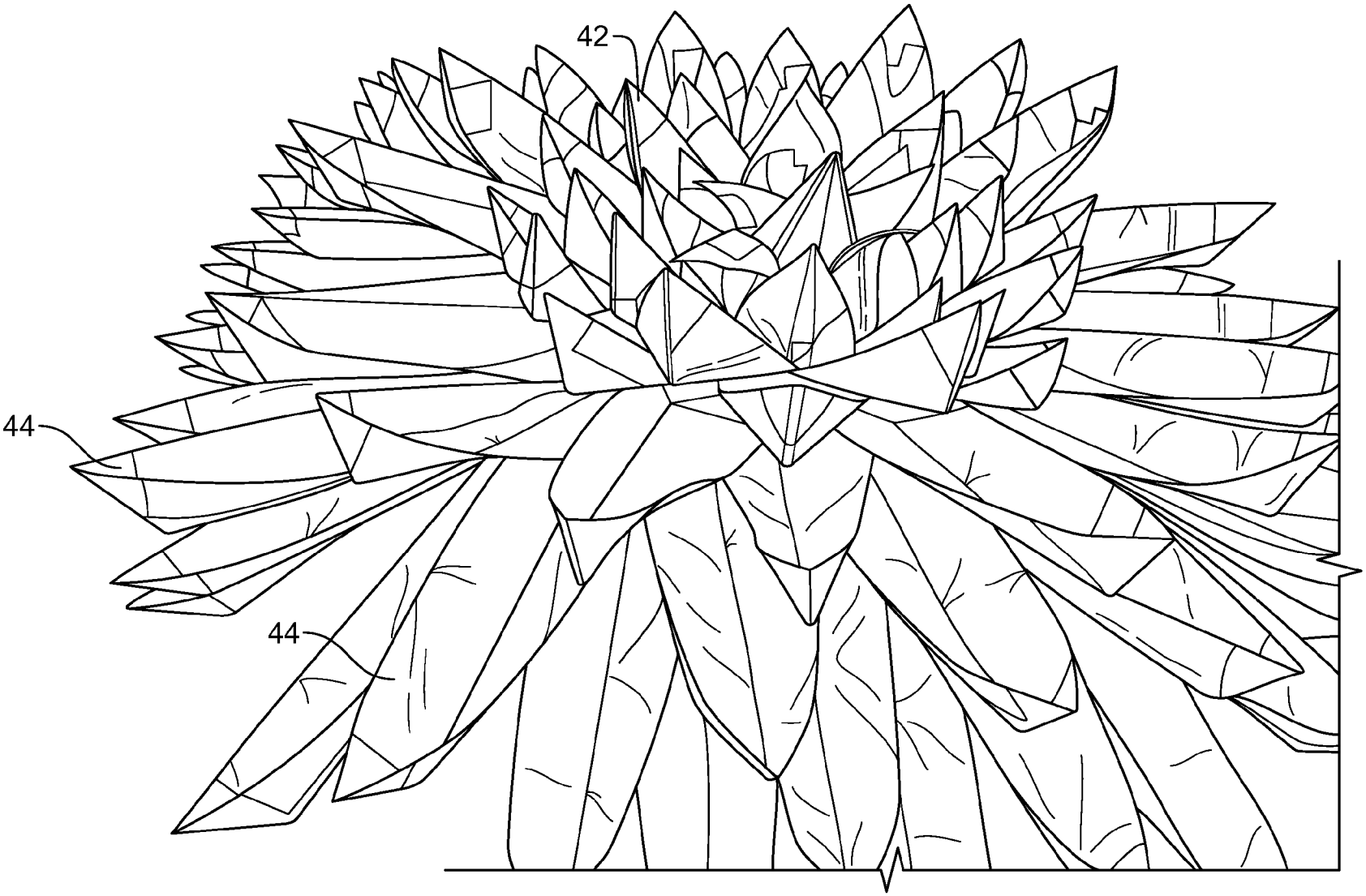
FIG. 11 is a perspective view of a portion of an ornamental funeral flower.
Figure 12:
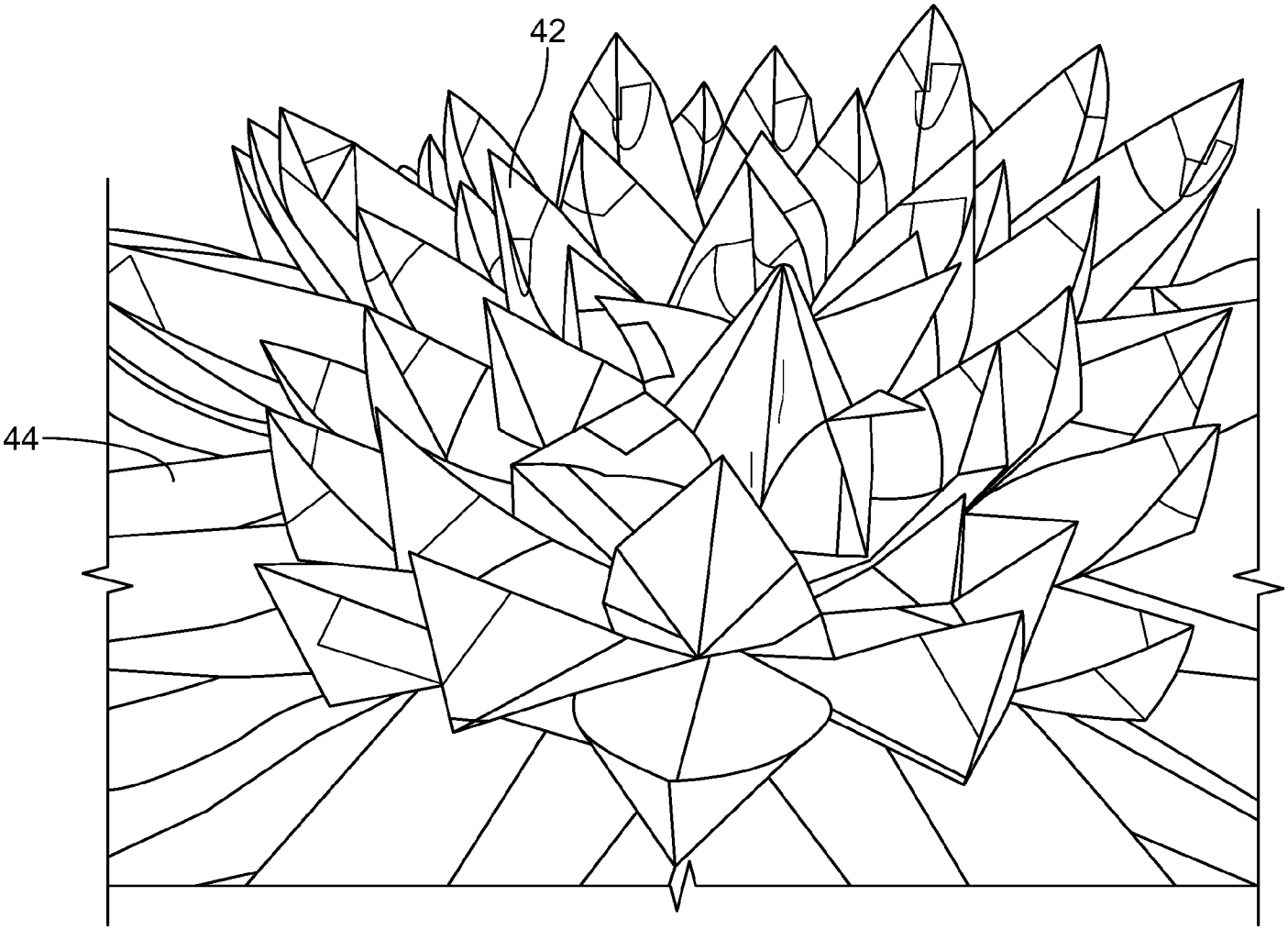
FIG. 12 is a perspective view of a portion of the ornamental funeral flower of FIG. 11.

As shown in FIGS. 11 and 12, some of the petals 42 are placed on the flower 2 without cutting the petals 42. These petals 42 extend across the top of the flower 2 to form two petals. Other petals 44 are cut and placed on the sides of the flower 2. The petals 42, 44 are attached using one or more of the methods described above, such as hot glue.

Figure 13:
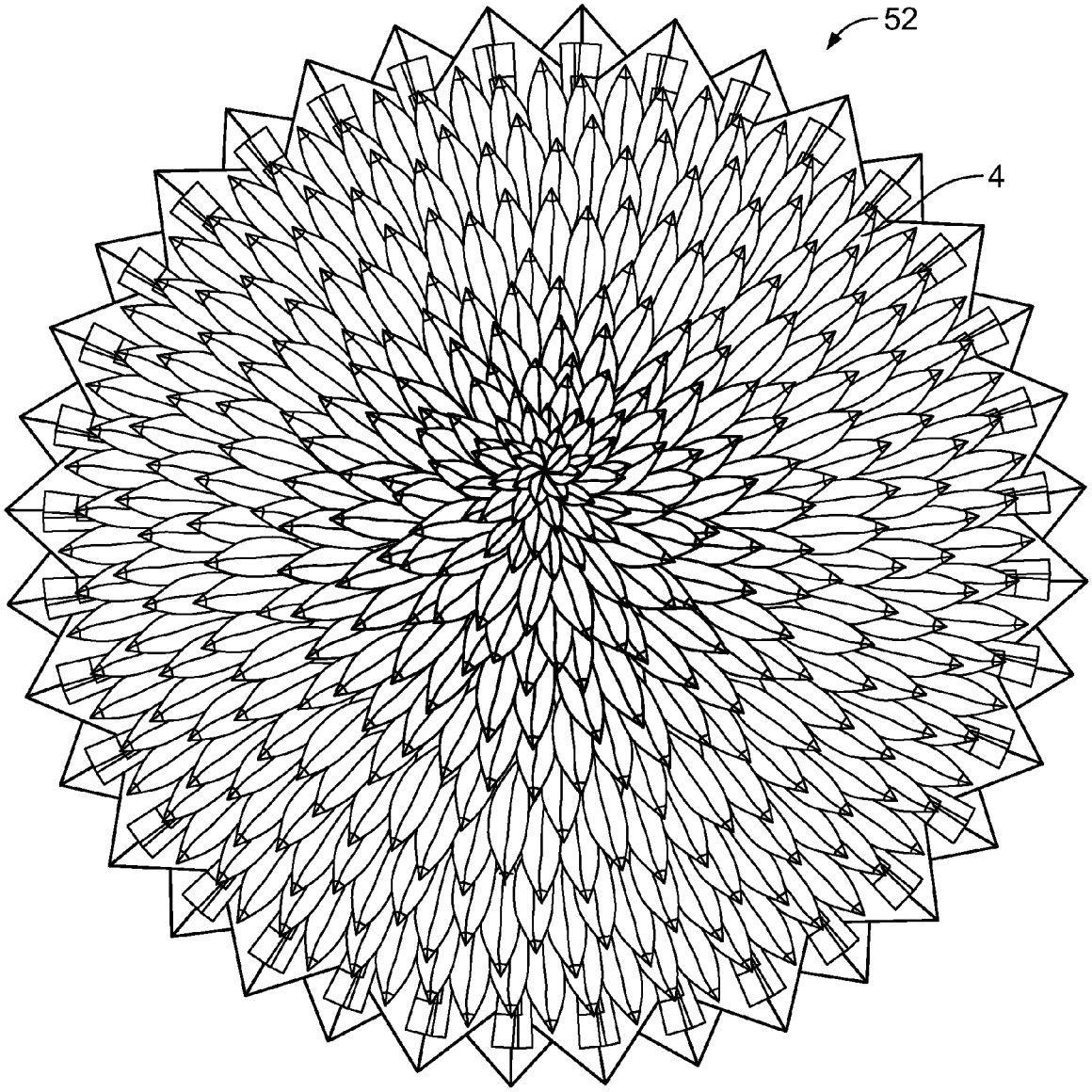
FIG. 13 is a front view of another ornamental funeral flower.

The ornamental funeral flowers may take any shape as desired by a customer. In one embodiment, as depicted in FIG. 1, the flower 2 may be formed in the shape of a heart. In another embodiment shown in FIG. 13, the flower 2 may take the shape of a circle. Other shapes, such as squares, rectangles, octagons, etc. can be used.

Figure 14:
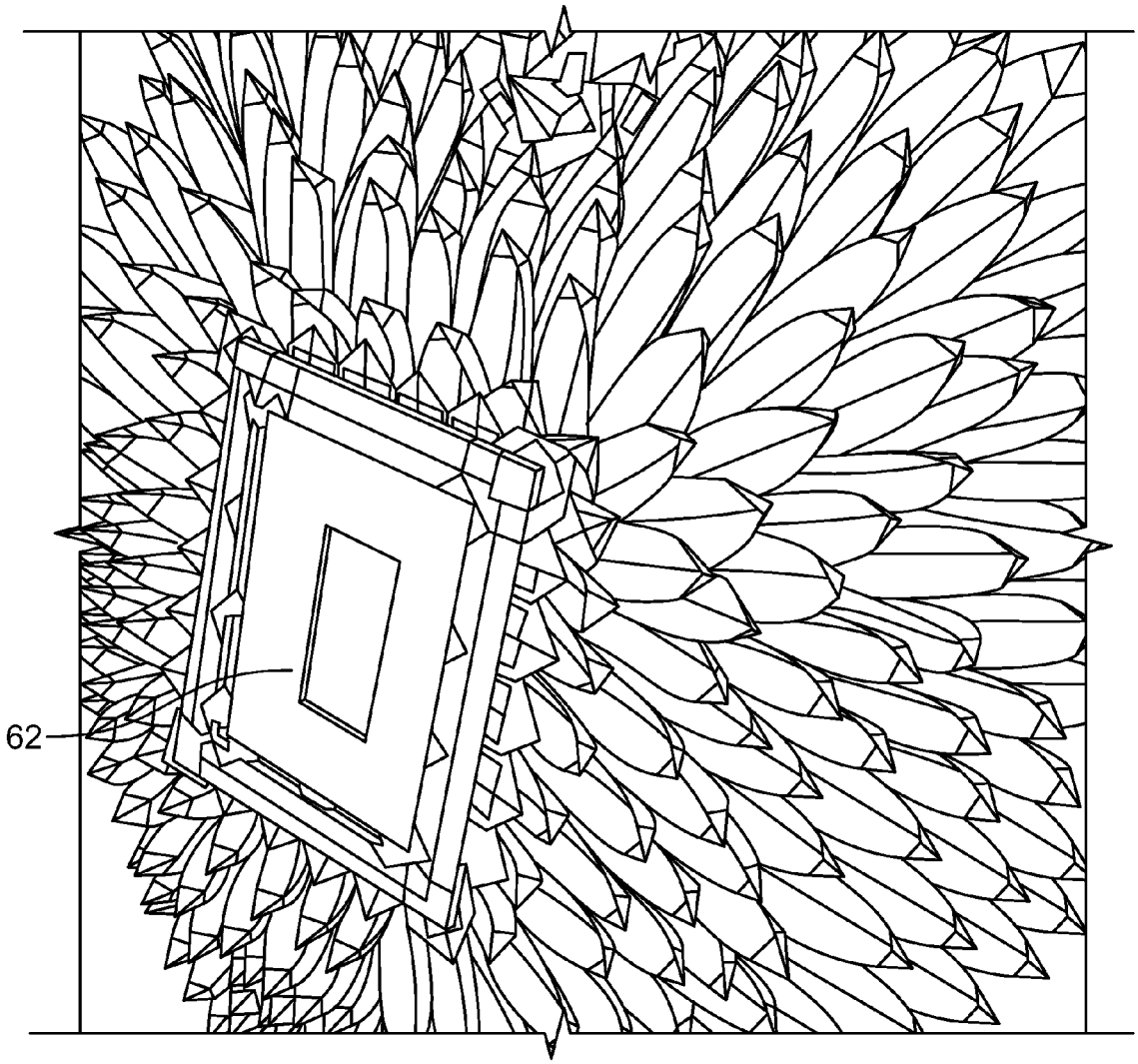
FIG. 14 is a front view of another ornamental funeral flower.

In other examples, the flowers can include other ornamentation, such as a photograph holder 62 shown in FIG. 14. The photograph holder 62 can be affixed to the flower to hold a photograph.

Figure 15:
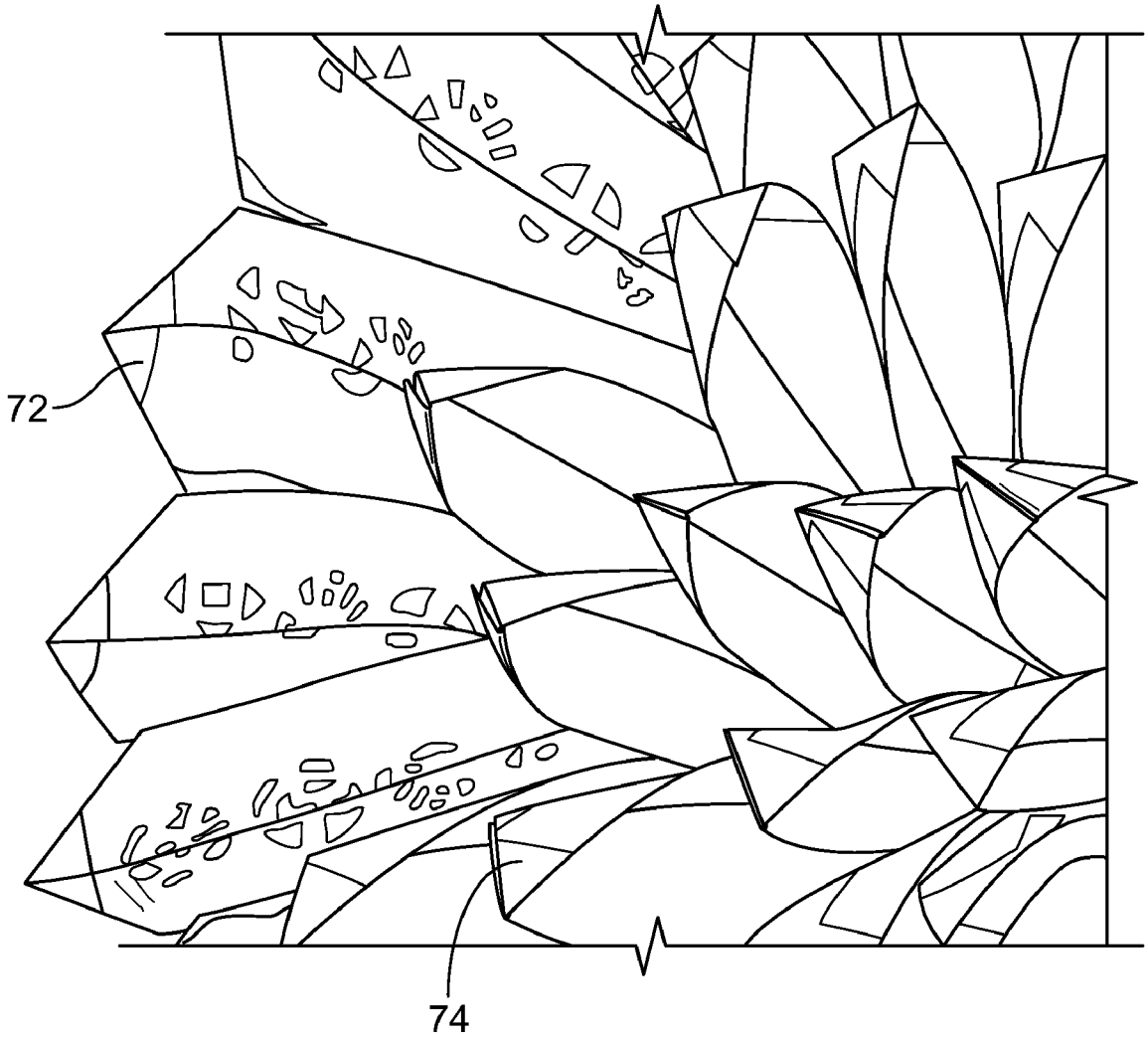
FIG. 15 is a front view of a portion of another ornamental funeral flower.

Petals of different shape, size, and/or color can be used. For example, as shown in FIG. 15, petals 72 are formed of a first type of paper, and petals 74 are formed of a second type of paper. Other configurations are possible.

The ornamental funeral flowers can be formed in a variety of sizes. In some embodiments, the flowers are generally between 1-6 feet in diameter. In other examples, the flowers are at least 1 foot, 2 feet, 3 feet, 4 feet, or 5 feet. In another example, the flowers are less than 6 feet, less than 5 feet, or less than 4 feet in diameter. In some examples, the flowers are 3-5 feet in diameter. Other sizes are possible.

The various embodiments described above are provided by way of illustration only and should not be construed to limiting. Various modifications and changes that may be made to the embodiments described above without departing from the true spirit and scope of the disclosure.

What is claimed is:

1. An ornamental funeral flower, comprising:

a base;

a riser fixedly attached to a center of said base;

a plurality of support members extending from the riser to an edge of the base; and a plurality of petals coupled to the base, each of the plurality of petals including a folded sheet of Joss paper;

wherein each petal is attached to the flower using an adhesive.

2. The ornamental funeral flower of claim 1, further comprising an attachment layer attached to one or more of said base, riser, and support members, wherein the petals are attached to the attachment layer.

3. The ornamental funeral flower of claim 2, wherein the base comprises cardboard.

4. The ornamental funeral flower of claim 2, wherein the riser is fixedly attached to the attachment layer by an adhesive.

5. The ornamental funeral flower of claim 4, wherein the adhesive is a thermoplastic adhesive resin.

6. The ornamental funeral flower of claim 2, wherein the plurality of support members comprise cellophane tape.

7. The ornamental funeral flower of claim 2, wherein the attachment layer comprises paper.

8. The ornamental funeral flower of claim 7, wherein the attachment layer comprises masking paper.

9. The ornamental funeral flower of claim 1 further comprising a picture frame fixedly attached to the attachment layer.

10. The ornamental funeral flower of claim 1, wherein the adhesive is a thermoplastic adhesive resin.

11. A method of making an ornamental funeral flower comprising:

providing a base;

attaching a riser to said base;

extending a plurality of support members from the riser to the base, wherein each of the plurality of support members comprising cellophane tape, draping an attachment layer over said base and said riser; and attaching a plurality of petals to said attachment layer.

12. The method of claim 11, wherein the step of attaching the riser to the base further comprises the step of providing a thermoplastic adhesive resin between the base and the riser.

13. The method of claim 11, wherein the step of attaching the plurality of petals to the attachment layer further comprises the step of providing a thermoplastic adhesive resin between the attachment layer and the plurality of petals.

14. The method of claim 11, wherein the each of the plurality of petals comprises a sheet of Joss paper.

15. The method of claim 14, further comprising the step of folding the sheet of Joss paper into a petal shape.

16. The method of claim 11, wherein the base comprises cardboard.

17. An ornamental funeral flower comprising:

a base including cardboard;

a riser fixedly attached to a center of said base using an adhesive;

a plurality of support members including tape extending from the riser to an edge of the base;

an attachment layer attached to one or more of said base, riser, and support members;

a plurality of petals fixedly attached to the attachment layer, wherein each of the plurality of petals comprise a folded sheet of Joss paper, and each petal is fixedly attached to the attachment layer by a thermoplastic adhesive resin; and a picture frame fixedly attached to the attachment layer.

* * * * *